US007810921B2

(12) United States Patent
Izawa et al.

(10) Patent No.: US 7,810,921 B2
(45) Date of Patent: Oct. 12, 2010

(54) PRINTING APPARATUS

(75) Inventors: Hideo Izawa, Narashino (JP); Akira Ishikawa, Narashino (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 933 days.

(21) Appl. No.: 11/656,066

(22) Filed: Jan. 23, 2007

(65) Prior Publication Data

US 2007/0172285 A1 Jul. 26, 2007

(30) Foreign Application Priority Data

Jan. 26, 2006 (JP) ..... 2006-017458

(51) Int. Cl.
*B41J 2/01* (2006.01)

(52) U.S. Cl. ..... 347/102; 347/104; 347/101

(58) Field of Classification Search ..... 347/102, 347/101, 100, 103, 104; 101/223
See application file for complete search history.

(56) References Cited

U.S. PATENT DOCUMENTS

| | | | | |
|---|---|---|---|---|
| 2,680,404 | A * | 6/1954 | Royer | 101/223 |
| RE24,948 | E * | 3/1961 | Zuckerman | 101/179 |
| 3,906,855 | A * | 9/1975 | Laursen | 101/223 |
| 2003/0081227 | A1 | 5/2003 | Williams et al. | |

FOREIGN PATENT DOCUMENTS

| | | | |
|---|---|---|---|
| EP | 1 738 916 | | 1/2007 |
| GB | 2258191 A | * | 2/1993 |
| JP | 01-157860 | | 6/1989 |
| JP | 2004 223765 | | 8/2004 |
| JP | 2004-224002 | * | 8/2004 |

OTHER PUBLICATIONS

Search Report dated Apr. 19, 2007 for the European Application No. 07 10 1065.

* cited by examiner

*Primary Examiner*—Manish S Shah
(74) *Attorney, Agent, or Firm*—Cohen Pontani Lieberman & Pavane LLP

(57) ABSTRACT

To allow continuous paper to be printed a plurality of times with a time difference by ink jet printer equipment and dried each time of printing while preventing condensation from occurring on an ink discharge surface of print head at and after the second time of printing, there is provided a printing apparatus comprising: a plurality of trains of printing units each of which has print heads arranged along a direction in which a continuous sheet of paper travels and which are arranged parallel to one another as shifted mutually in position in a direction of width of the continuous sheet of paper; a dryer section in which a plurality of continuous sheets of paper from the plural printing unit trains can travel as mutually shifted in position in a direction of width of the continuous sheet of paper; a cooling roller unit disposed downstream of the dryer section and having a cooling roller on which the plurality of continuous sheets of paper from the dryer section can be wound as mutually shifted in position in a direction of width of the continuous sheet of paper; and a turnover unit disposed between the cooling roller unit and a train of printing units for shifting the continuous sheet of paper in position into a direction of its width while reversing the direction in which it travels.

9 Claims, 4 Drawing Sheets

PRINTING APPARATUS

BACKGROUND OF THE INVENTION

1. Technical Field

The present invention relates to a printing apparatus in which continuous paper is printed at least twice with a time difference on one or both of its front and back faces by ink jet printer equipment and is dried as it is passed through a dryer section at each time of printing.

2. Description of the Prior Art

A printing apparatus in which continuous paper is printed twice with a time difference on both of its front and back sides by ink jet printer equipment and is dried as it is passed through a dryer at each time of printing has already been applied for in a patent application filed by the present applicant (see JP 2004-224002 A).

There is also a printing apparatus which is equipped with a heater body for heating continuous paper and in which a moisture condensation or absorbing member is provided in the vicinity of an ink discharge nozzle in a print head to prevent a printing trouble from occurring from condensation on the ink discharge nozzle surface (see JP H01-157860 A).

In a printing apparatus as described in JP 2004-224002 A, when printed continuous paper heated through the dryer for drying the print is again passed along the lower surface of the print head in the ink jet printer equipment, water drops may be created by the condensation on an ink discharge nozzle surface in the print head caused by a temperature difference between the continuous paper and the print head which is lower in temperature than the former with the result that a printing trouble may take place.

On the other hand, in a printing apparatus as described in JP H01-157860 A, while water vapor produced at a place of the paper surface opposed to the print head can be removed by the moisture condensing or absorbing member provided in the vicinity of the print head, there are differences between discontinuous sheets of paper and continuous paper in paper to be printed and also large differences in transport and printing speeds of paper. Thus, with a printing apparatus using continuous paper that is high in both transport and printing speeds, it is difficult to have the rate of condensation and the rate of moisture absorption reaction follow the travel of continuous paper and hence to prevent printing troubles from taking place due to the condensation on the print head.

SUMMARY OF THE INVENTION

Made with the above-mentioned problem taken into account, the present invention has for its object to provide a printing apparatus in which if continuous paper is heated from printing to printing, namely at each time of printing, by storage of dryer heat, it will not then become higher in temperature than an ink discharge surface nor will it give rise to condensation by a temperature difference on the ink discharge nozzle surface and if the continuous paper is transported at a high speed to gain a high printing speed, moisture in ink will not then generate water vapor on a print head, thereby making it possible to prevent printing troubles on continuous paper from occurring from the condensation on the ink discharge nozzle surface in the print head.

In order to achieve the object mentioned above, there is provided in accordance with the present invention a printing apparatus which comprises a plurality of trains of printing units each of which has print heads arranged along a direction in which a continuous sheet of paper travels and which are arranged parallel to one another as shifted mutually in position in a direction of width of the continuous sheet of paper; a dryer section in which a plurality of continuous sheets of paper from the plural printing unit trains can travel as mutually shifted in position in a direction of width of the continuous sheet of paper; a cooling roller means disposed downstream of the dryer section and having a cooling roller on which the plurality of continuous sheets of paper from the dryer section can be wound as mutually shifted in position in a direction of width of the continuous sheet of paper; and a turnover means disposed between the cooling roller means and the printing unit trains for shifting the continuous sheet of paper in position into a direction of its width while reversing the direction in which it travels.

In a printing apparatus as mentioned above, the turnover mean is adapted either to keep the front and back faces of the continuous sheet of paper not inverted or to invert the front and back faces of the continuous sheet of paper.

According to the present invention, if a face of paper printed by printing units is heated for drying, it can then be cooled by the cooling roller means each time continuous paper from the printing unit train is passed through the dryer section. And, if continuous paper is traveling at an increased speed, it can then be printed at and after the second printing without being influenced by heating in the dryer section in the preceding printing, thereby preventing condensation from occurring on an ink discharge surface of print head at and after the second printing. Thus, in a printing apparatus in which continuous paper traveling at an increased speed is printed on one or both its front and back faces at least twice with a time difference by ink jet printer and is heated for drying in the dryer section each time of printing, it is possible to effect printing at and after the second time without causing printing troubles due to occurrence of condensation around a print head.

Further, according to the present invention, by having a cooling roller on which a plurality of continuous sheets of paper from the dryer section can be wound as mutually shifted in position in a direction of width of the continuous sheet of paper, the cooling roller means can be constructed to achieve cooling and discharging a plurality of continuous sheets of paper with the common cooling roller and with space saving.

In a printing apparatus as mentioned above, the continuous sheet of paper past the downstream-most unit trains of a plurality of trains of printing units and then past the dryer section may be discharged into its outside without passing through the cooling roller means.

According to this makeup, the continuous sheet of paper which has been printed by the downstream-most unit trains of a plurality of trains of printing units and which need no longer be printed can be discharged directly without passing it through the cooling roller means.

DESCRIPTION OF PREFERRED EMBODIMENTS

Figure 1:
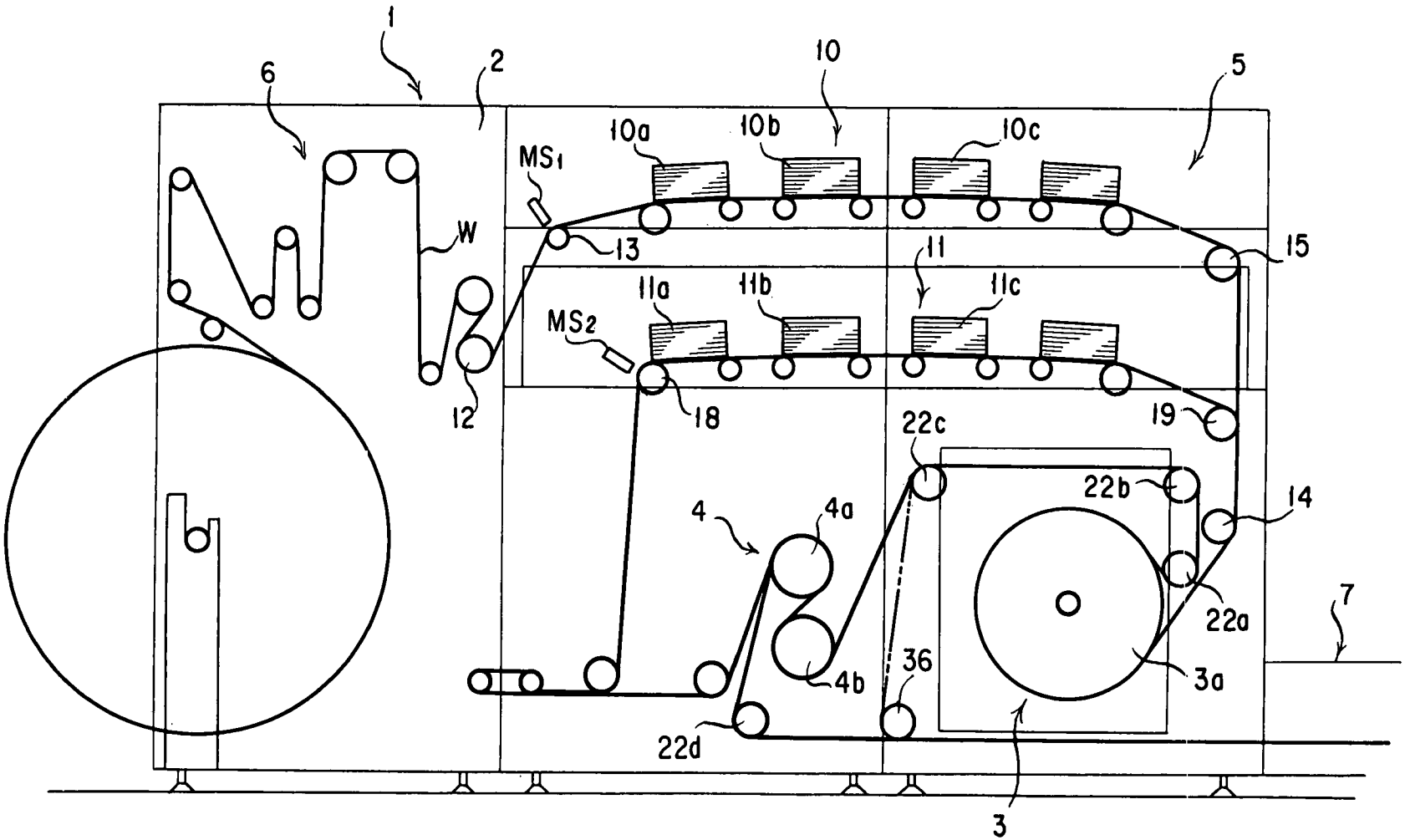
FIG. 1 is a front view illustrating a printing apparatus representing a form of implementation of the present invention.

An explanation is given hereinafter of preferred forms of embodiment for carrying out the present invention with reference to the drawing figures.

Figure 2:
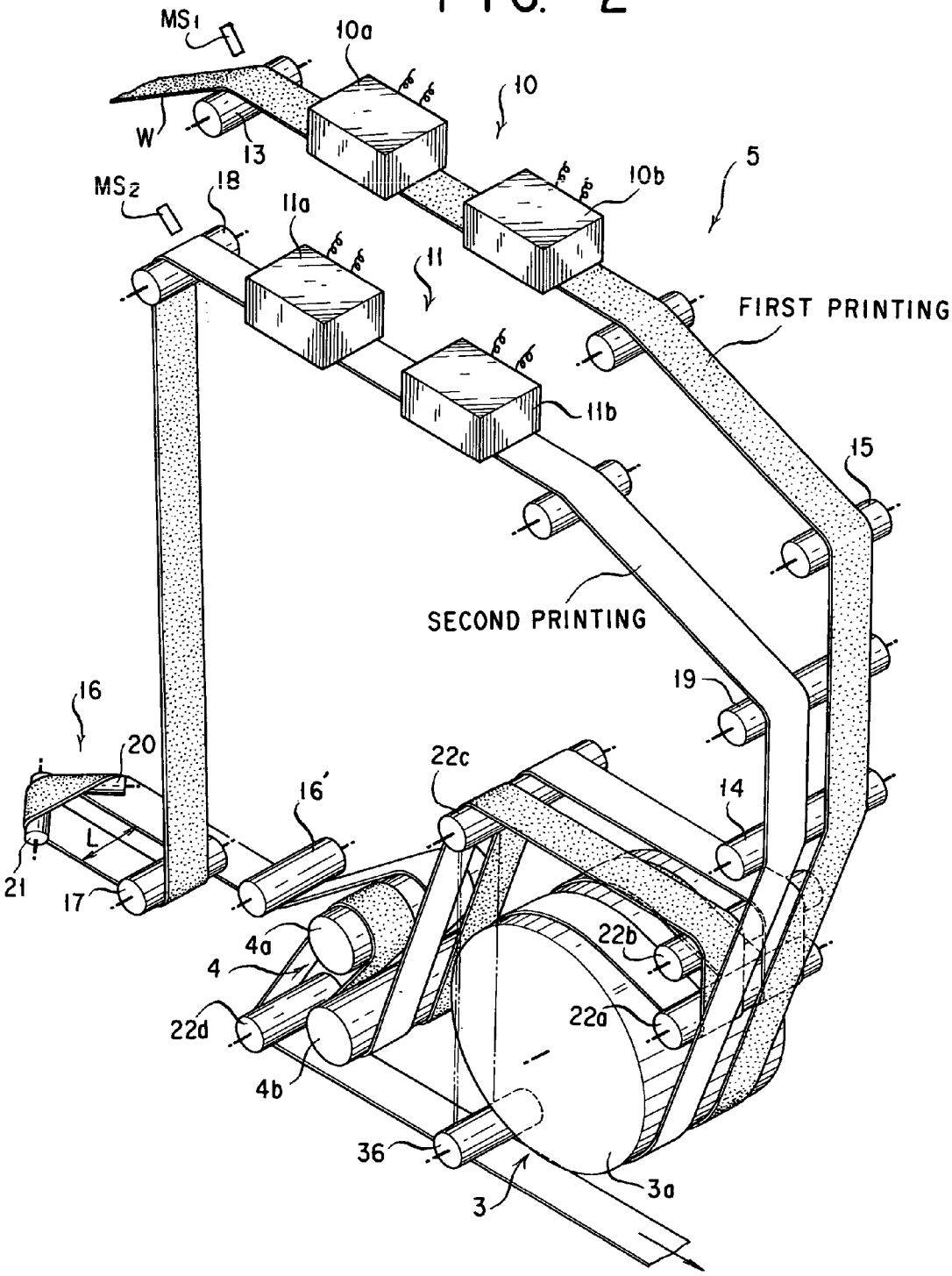
FIG. 2 is a perspective view illustrating essential parts of the printing head shown in FIG. 1.

FIGS. 1 and 2 show a printing apparatus 1 for printing both front and back sides of continuous paper with a time difference, using aqueous ink by means of ink jet printer equipment. The printing apparatus 1 is provided below a machine frame 2 with a dryer section 3 and a cooling roller unit 4 and above them with a printing section 5. Continuous paper W supplied traveling laterally from a paper feeder 6 disposed at one side (left hand side in this form of implementation) is printed on its front and back sides through the printing section 5 sequentially with a time difference, dried through the dryer section 3, cooled through the cooling roller unit 4 and discharged from a discharge section 7 disposed at the other side (right hand side in this form of implementation) of the machine frame 2. Continuous paper W is then taken up onto a winder (not shown) disposed downstream of the discharge section 7, or alternatively is worked at a working section such as of a folding machine.

It should be noted here that the terms "front" and "back" faces of continuous paper W in this form of implementation are used to simply means nothing but one (a first) and the other (a second) surface of continuous paper W, respectively.

The dryer section 3 used includes a known dryer of drum type using a drying drum 3*a* whose surface is heated to a selected temperature by a built-in heater and which is freely rotated or driven to follow traveling continuous paper W as wound thereon to dry printing made on continuous paper W in contact with its surface.

The cooling roller unit 4 comprises a pair of rollers 4*a* and 4*b* on which continuous paper W from the dryer section 3 is wound in the form of an S as viewed laterally.

In the printing section 5, a first and a second train of printing units 10 and 11 are arranged substantially at the same position in a direction of travel of continuous paper W and positioned vertically deviated and horizontally deviated in a direction of the width of continuous paper by a length L larger than the width of continuous paper W. And, beneath the printing unit trains 10 and 11 are provided printing paths, respectively, along which continuous paper W travels in opposed position to each of the printing unit trains 10, 11. While the printing unit trains 10 and 11 are shown vertically deviated, it should be noted that they may be vertically at a same level.

Each of the printing unit trains 10 and 11 comprises one or more ink jet printer print heads 10*a*, 10*b*, 10*c*, . . . ; 11*a*, 11*b*, 11*c*, . . . , each of which faces downwards. FIG. 2 for ease of understanding diagrammatically shows the makeup shown in FIG. 1, in which two ink jet printer print heads are shown for each of the printing unit trains 10 and 11 as 10*a* and 10*b*; 11*a* and 11*b* although a single ink jet printer for each may be sufficient.

Arranged upstream of the first printing unit train 10 forming an upper part of the printing section 5 is an inlet roller 13 which guides continuous paper W from a feed roller (pull roller) 12 in the paper feeder 6. And, arranged downstream of the first printing unit train 10 is a an outlet roller 15 which guides continuous paper W therefrom towards an inlet roller 14 in the dryer section, the rollers 13 and 15 constituting a printing path opposed to the first printing unit train 10.

Also, arranged upstream of the second printing unit train 11 forming a lower part of the printing section 5 is an inlet roller 18 which guides continuous paper W from an outlet roller 17 in a turnover unit 16 to be described below. And, arranged downstream of the second printing unit train 11 is an outlet roller 19 which guides continuous paper W therefrom towards an inlet roller 14 in the dryer section, the rollers 18 and 19 constituting a printing path opposed to the second printing unit train 10.

The turnover unit 16 comprises an inlet roller 16', a pair of turn bars 20 and 21 arranged in the form of a V and the outlet roller 17. The turnover unit 16 is arranged between the exit side of the cooling roller unit 4 and the inlet roller 18 for the second printing unit train 11 and is so designed that when continuous paper W is passed through the dryer section 3 and the cooling roller unit 4 from the first printing unit train 10 into the inlet roller 16', the turnover unit 16 acts on continuous paper W so as to reverse the direction in which it travels to shift its phase by the abovementioned size L in the direction of its width while leaving its one side face facing one side (leaving its front and back sides not inverted) over the incoming and outgoing paths and guides it towards the inlet roller 18 in the second printing unit train 11 via the outlet roller 17.

Disposed at the outlet side of the dryer section 3 so as to surround the drying drum 3*a* are a plurality of outlet guide rollers such as a first, a second, a third, a fourth roller 11*a*, 22*b*, 22*c*, 22*d* for directing continuous paper W to travel towards the cooling roller unit 4 in a direction opposite to that in which it passes the first printing unit train 10. Of these rollers disposed around the drying drum 3*a*, the first, second and third rollers 22*a*, 22*b* and 22*c* as well as the inlet roller 14 and two cooling rollers 4*a* and 4*b* in the cooling roller unit 4 are double-wound rollers which guides two parallel rows of continuous paper W and W shifted in position by the length L in a direction of the width of continuous paper W corresponding to the first and second printing unit trains 10 and 11 and are freely rotatable.

The two cooling rollers 4*a* and 4*b* in the cooling roller unit 4 to cool continuous paper W wound on their peripheral surfaces need to keep these peripheral surfaces at a low temperature. One exemplary means for keeping the temperature low is a coolant such as water circulated through the cooling rollers 4*a* and 4*b*.

Figure 3:
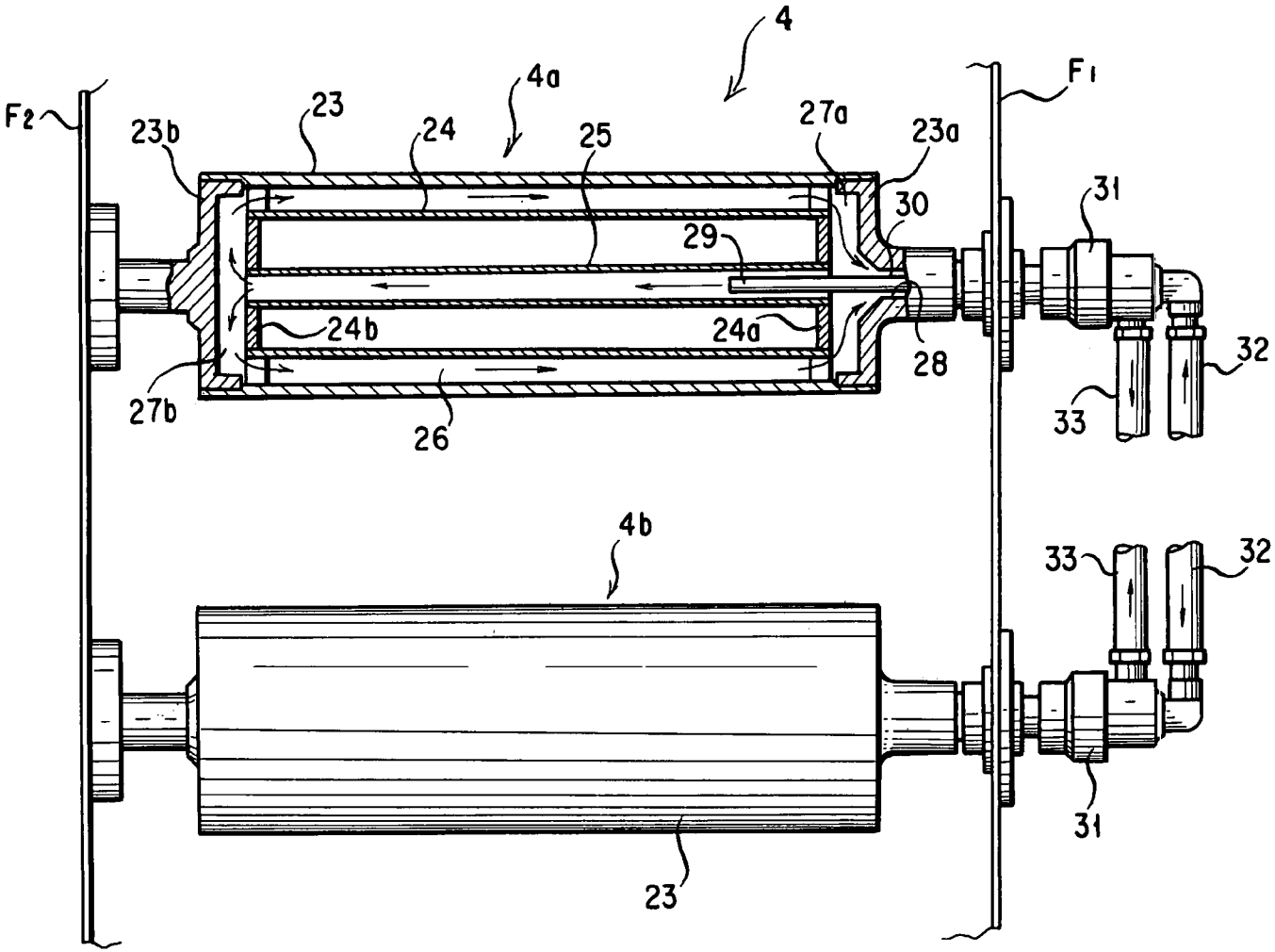
FIG. 3 is cross sectional view, in part broken, illustrating an exemplary cooling roller in the printing apparatus shown in FIGS. 1 and 2.
Figure 4:
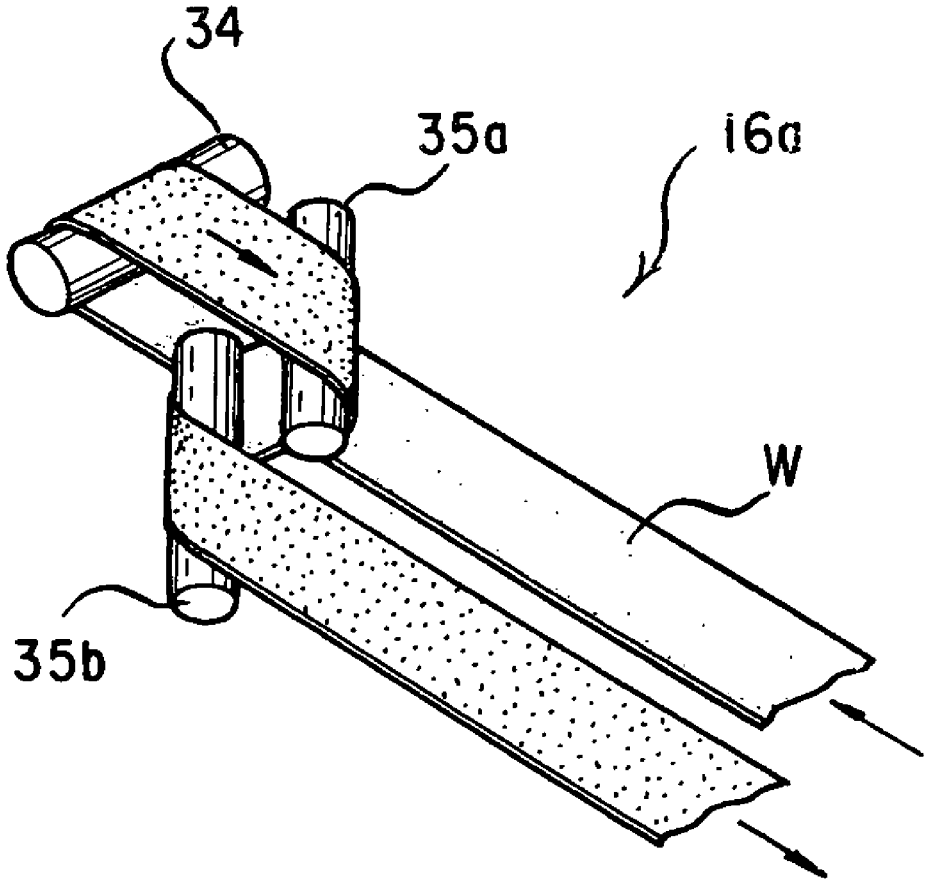
FIG. 4 is a perspective view illustrating another embodiment of the turnover means in the printing apparatus shown in FIGS. 1 and 2.

FIG. 3 shows one example. Since the cooling rollers 4*a* and 4*b* are identical in makeup, an explanation will be given for one cooling roller 4*a* only.

The cooling roller 4*a* comprises an outer cylinder 23, an inner cylinder 24 disposed in the outer cylinder 23 coaxially therewith with a stay and a tubular member 25 disposed at a center axis of the inner cylinder 24.

And, the outer cylinder 23 is closed at their ends with end members 23*a* and 23*b* and is axially rotatably supported with frames F1 and F2. Also, the inner cylinder 24 is closed at their ends with side plates 24*a* and 24*b*. And, a cooling chamber 26 whose cross section is that of a doughnut is formed between the outside of the inner cylinder 24 and the inside of the outer cylinder 23. Also, axially outside of the side plates 24*a* and 24*b*, spaces 27*a* and 27*b* are formed, respectively, which communicate with the cooling chamber 26. The tubular member 25 passes through the side plates 24*a* and 24*b* and are fastened to them so that its ends are open to the spaces 27*a* and 27*b*, respectively.

One end member 23*a* of the outer cylinder 23 is axially formed with a through-hole 28 into which an inflow tube 29 is inserted. The inflow tube 29 has a length which extends from the outside of the end member 23*a* into the tubular member 25. The inflow tube 29 has an outer diameter which is sufficiently small so that between its outside and the inside of the through-hole 28 of the end member 23*a*, there is formed a return passage 30 whose cross section is that of a doughnut and through which the space 27*a* inside of the outer cylinder 23 communicates with an end of the end member 23*a* of the outer cylinder 23.

At the end of the end member 23*a* having the return passage 30 of the outer cylinder 23, a swivel joint 31 which communicates individually with an end of the inflow tube 29 and the return passage 30 is supported rotatably relative to the end member 23*a* by a support member (not shown). The swivel joint 31 has connected thereto an inflow channel 32 that communicates with the inflow tube 29 and a return channel 33 that communicates with the return passage 30. The inflow channel 32 and the return channel 33 are connected to a water pump and a return water reservoir (both of which are not shown), respectively.

In this cooling roller unit 4, a water coolant introduced from the inflow channel 32 of each of the cooling rollers 4*a* and 4*b* is passed through the inflow tube 29, the tubular member 25, the space 27*b*, the cooling chamber 27*a* and the return channel 30 and is returned to each of the return channels 33, 33 of the cooling roller 4*a*, 4*b*, thereby cooling meanwhile each of the peripheries of the outer cylinders 23 and 23.

In operation of the apparatus so constructed as mentioned above:

Continuous paper W printed in advance with a selected pattern in another printing process is supplied from the paper feeder 6 through the feed roller 12 and further through the inlet roller 13 into the first printing unit train 10 in the printing section 5, for example with the back face of paper facing upwards. In this first printing unit train 10, paper is printed with the ink jet printer print heads 10*a*, 10*b*, . . . operated in accordance with a detection signal by a mark sensor MS1 (first printing).

The continuous paper W printed in this way on its back face is introduced from the outlet roller 15 of the first printing unit train 10 via the inlet roller 14 into the dryer section 3 where it is dried. Then, the continuous paper W is passed through the outlet guide rollers 22*a*, 22*b* and 22*c* of the dryer section 3 to pass in the form of S through the two cooling rollers 4*a* and 4*b* in the cooling roller unit 4 where the continuous paper W elevated in temperature by the dryer section 3 is cooled.

At this time, namely past the dryer section 3 and the cooling roller unit 4, the continuous paper W by traveling in a direction opposite to that in which it traveled past the first printing unit train 10 has its printable face inverted to face its front face upwards. If the continuous paper W as it is turned back and supplied to the second printing unit train 11, it would be again inverted to face its back face upwards again.

Then, as shown in FIG. 2 the turnover unit 16 with the two turn bars 20 and 21 acts on the continuous paper W so as to reverse the direction in which it travels to shift its position in a direction of its width while leaving its one side face facing one side (leaving its front and back sides not inverted) over the incoming and outgoing paths to turn it in the forward direction. This causes the continuous paper W leaving the outlet roller 17 of the turnover unit 16 to advance via the inlet roller 18 and to be fed, while being inverted, to the second printing unit train 11 in the printing section 5 where it is printed on its front face as selected (second printing) by the ink jet printer print heads 11*a*, 11*b*, 11*c*, . . . The printing at this time, too, is effected as timed in accordance with a detection signal from a mark sensor MS2. The printing at this time is effected substantially at the same position in the direction of travel of continuous paper W as in the printing with the first printing unit train 10 but at a position shifted downward thereof and in a direction of the width of continuous paper W.

Thus, the continuous paper W printed on its front face travels on the outlet roller 19 of the second printing unit train 11 in the state that it is shifted from the continuous paper W printed on its back face, in position in the direction of its width and then enters again in the dryer section 3 where it is again heated. Then, after it is cooled in the cooling roller unit 4, the continuous paper W enters via the discharge roller 22*d* into the discharge passage from where it is discharged through the discharge section 7.

As mentioned above, the continuous paper W printed on its back and front faces with a time difference with a first and a second train of printing units, respectively, is dried by the dryer 3 immediately after its respective printings and is then cooled by the cooling roller unit 4. The cooling by this cooling roller unit 4 is such that the continuous paper W heated by the dryer drum 3*a* is cooled wherein a part of water content vaporized and floating in the vicinity of continuous paper W is de-heated and condensed and again absorbed in the continuous paper W.

The continuous paper W which as described above has been first printed on its back face in the printing section 5 and is then to be second printed on its front face in the printing section 5 has a reduced amount of water vapor floating adjacent thereto and this prevents condensation onto the ink discharge surfaces of the print heads 11*a*, 11*b*, . . . , which are to print the second time.

The cooling rollers 4*a* and 4*b* of the cooling roller unit 4 have their outer cylinders 23 which should preferably be as thin as possible to enhance their cooling effect and be composed of a material that is high in thermal conductivity such as steel, aluminum or copper.

The cooling rollers 4*a* and 4*b* may have either a structure that it is rotated by a contact pressure onto them by continuous paper W traveling or a structure that it is rotated driven by being coupled to a drive source.

The coolant circulated through the cooling rollers 4*a* and 4*b* may make available a coolant circulation system in ink jet printer equipment to operate in conjunction with the latter. Also, in accordance with working conditions such as the need to prevent condensation on the surfaces of the cooling rollers 4*a* and 4*b* when the ink jet printers are at halt, the circulating path for a coolant such as chilled, cold or warm water may selectively be activated to pass and circulate the coolant. Further, a temperature of continuous paper W traveling may be measured and in accordance therewith the operation of a temperature controller in the circulation unit may be controlled.

The cooling roller unit 4 may, instead of two, use one or three or more, cooling rollers 4*a*, 4*b*. Further, the winding angle of continuous paper W onto a cooling roller 4*a*, 4*b* is preferably 90° or more.

While in the form of implementation illustrated above, both the back and front faces of continuous paper W are shown printed, only one side face of continuous paper W may be printed twice (or a plurality of times).

In this case, use may be made of a modified turnover unit 16*a* which comprises one front and back inverting roller 34 and a pair of turn bars 35*a* and 35*b* to invert continuous paper W from back to front while shifting its phase in a direction of its width by the length L.

With the turnover unit 16*a* so constructed as mentioned above, continuous paper W when traveling in both the first and second printing unit trains 10 and 11 can face its one face to the same side (without inverting front to back or vice versa) and can be printed on the same face.

Also, while in the form of implementation illustrated above, continuous paper W printed second (the last time) is shown discharged through the outlet guide roller 22*d* into the discharge section 7 after passing through the cooling roller unit 4, it may be discharged into the discharge section 7 without passing through the cooling roller unit since the continuous paper W printed second (the last time) need no longer be opposed to print heads.

In this case, ahead of the cooling roller unit 4, there may be provided another outlet guide roller 36 to guide the continuous paper W leaving the dryer section 3 after printed second (the last time) to bypass the cooling roller unit 4 and to run on the outlet guide roller 36 directly into the discharge section 7.

What is claimed is:

1. A printing apparatus comprising:

a plurality of trains of printing units each of which has print heads arranged along a direction in which a continuous sheet of paper travels, said plurality of printing unit trains being arranged parallel to one another and mutually shifted in position in a direction of a width of the continuous sheet of paper;

a dryer section in which a plurality of sections of the continuous sheet of paper from said plurality of printing unit trains travel as mutually shifted in position in the direction of the width of the continuous sheet of paper;

a cooling roller means disposed downstream of said dryer section and having a cooling roller on which the plurality sections of the continuous sheet of paper from said dryer section are capable of being wound as mutually shifted in position in the direction of the width of the continuous sheet of paper; and a turnover means disposed between said cooling roller means and said printing unit trains for shifting the continuous sheet of paper in position in the direction of width of the continuous sheet of paper while reversing the direction in which the continuous sheet of paper travels.

2. The printing apparatus as set forth in claim 1, wherein said turnover means is adapted to keep front and back faces of the continuous sheet of paper not inverted.

3. The printing apparatus as set forth in claim 1, wherein said turnover means is adapted to invert front and back faces of the continuous sheet of paper.

4. The printing apparatus as set forth in claim 3, wherein the continuous sheet of paper traveling past a downstream-most unit train of the plurality of trains of printing units and then past said dryer section is discharged to an outside of the printing apparatus without passing through said cooling roller means.

5. The printing apparatus as set forth in claim 2, wherein the continuous sheet of paper traveling past a downstream-most unit train of the plurality of trains of printing units and then past said dryer section is discharged to an outside of the printing apparatus without passing through said cooling roller means.

6. The printing apparatus as set forth in claim 1, wherein the continuous sheet of paper traveling past a downstream-most unit train of the plurality of trains of printing units and then past said dryer section is discharged to an outside of the printing apparatus without passing through said cooling roller means.

7. The printing apparatus as set forth in claim 1, wherein the plurality sections of the continuous sheet of paper from said dryer section are wound on the cooling roller as mutually shifted in position in the direction of the width of the continuous sheet of paper.

8. A printing apparatus comprising:

a plurality of trains of printing units, each of the plurality of printing unit trains having print heads arranged along a travel path in which a continuous sheet of paper travels, said plurality of printing unit trains being arranged parallel to one another and mutually shifted in position in a direction of a width of the continuous sheet of paper;

a dryer section in which a plurality of sections of the continuous sheet of paper from said plurality of printing unit trains travel;

a cooling section disposed downstream of said dryer section and having a cooling roller on which the plurality sections of the continuous sheet of paper from said dryer section are wound as mutually shifted in position in the direction of the width of the continuous sheet of paper; and a turnover section disposed between said cooling section and a downstream printing unit train of the plurality of printing unit trains for shifting the continuous sheet of paper in position in the direction of width of the continuous sheet of paper while reversing the direction in which the continuous sheet of paper travels.

9. The printing apparatus as set forth in claim 8, wherein the dryer section comprises a drying drum on which the plurality of sections of the continuous sheet of paper from said plurality of printing unit trains are wound in a mutually shifted position in the direction of the width of the continuous sheet of paper.

* * * * *